US010258103B2

(12) United States Patent
Levinson

(10) Patent No.: US 10,258,103 B2
(45) Date of Patent: Apr. 16, 2019

(54) WATERSPORT SANDALS

(71) Applicant: Benjamin Lee Levinson, San Francisco, CA (US)

(72) Inventor: Benjamin Lee Levinson, San Francisco, CA (US)

(73) Assignee: Benjamin Lee Levinson, Santa Monica, CA (US)

( * ) Notice: Subject to any disclaimer, the term of this patent is extended or adjusted under 35 U.S.C. 154(b) by 52 days.

(21) Appl. No.: 15/410,728

(22) Filed: Jan. 19, 2017

(65) Prior Publication Data

US 2018/0199658 A1 Jul. 19, 2018

(51) Int. Cl.
*A43B 5/08* (2006.01)

(52) U.S. Cl.
CPC ..... *A43B 5/08* (2013.01)

(58) Field of Classification Search
CPC ..... A43B 3/12; A43B 3/122; A43B 3/124; A43B 3/126; A43B 3/128; A43B 3/24; A43B 3/248
USPC ..... 36/11.5, 100, 102
See application file for complete search history.

(56) References Cited

U.S. PATENT DOCUMENTS 1,894,561 A * 1/1933 Guiffre ..... A43B 3/124 36/11
2,803,894 A * 8/1957 Morgan ..... A43B 3/128 36/11.5
3,002,297 A * 10/1961 Neilson ..... A43B 3/124 36/11.5
3,057,085 A * 10/1962 Rigsby ..... A43B 3/124 36/11
3,603,006 A * 9/1971 Davenport ..... A43B 3/106 36/11.5
3,871,116 A * 3/1975 Vanderlinden ..... A43B 3/106 36/11.5
4,030,212 A * 6/1977 Ito ..... A43B 3/106 12/142 S
4,751,784 A * 6/1988 Petker ..... A43B 3/106 36/11.5
5,737,853 A * 4/1998 Smejkal ..... A43B 3/101 36/11.5
6,298,580 B1 * 10/2001 Tadayon ..... A43B 3/106 36/11.5
6,792,697 B2 * 9/2004 Wright ..... A43B 1/10 12/142 S
7,032,327 B1 * 4/2006 Tartaglia ..... A43B 3/108 36/102
7,739,808 B2 * 6/2010 Cotton ..... A43B 3/106 36/11.5
8,555,524 B2 * 10/2013 Hammerbeck ..... A43B 3/248 36/11.5

(Continued)

FOREIGN PATENT DOCUMENTS

WO WO-8706801 A2 * 11/1987 ..... A43B 3/128

*Primary Examiner* — Joshua E Rodden

(57) ABSTRACT

A watersports sandal is disclosed. The sandal has a flexible sole that underlies and protects a user's foot in a walking configuration. The sandal has a detachable forefoot strap that connects the sole to the user's forefoot and an ankle strap that connects the heel portion of the sole to the lower leg of the user. The sandal can be reconfigured to a stowed configuration in which the forefoot strap attaches the sole to a user's lower leg. In this stowed configuration, the user's bare feet are exposed to allow him fine sensitivity to water sport devices such as surf boards.

15 Claims, 3 Drawing Sheets

(56) References Cited

U.S. PATENT DOCUMENTS

| | | | | |
|---|---|---|---|---|
| D807,619 | S * | 1/2018 | Halmaghi | D2/916 |
| 2004/0025372 | A1* | 2/2004 | Watanabe | A43B 1/0081 36/8.1 |
| 2004/0055179 | A1* | 3/2004 | Wang | A43B 3/103 36/11.5 |
| 2011/0016745 | A1* | 1/2011 | Hammerbeck | A43B 3/126 36/11.5 |
| 2018/0027918 | A1* | 2/2018 | Almshal | A43B 3/12 |

* cited by examiner

WATERSPORT SANDALS

FIELD OF THE INVENTION

The present invention relates to footwear for engaging in watersports, and in particular for shielding the foot from sharp or uncomfortable objects in a walking configuration, but being reconfigurable to expose bare feet in a stowed configuration.

BACKGROUND

Participation in water sports can expose the feet to sharp or otherwise harmful objects. For example, in a surfing environment, the beach may be encumbered with rocks, shells, and other sharp objects. In some cases, the sand can be hot and uncomfortable. Even after wading into the water, it is not uncommon for surfers to encounter coral or sharp rocks on the seabed.

It is therefore advisable for persons engaging in such watersports to wear some kind of foot protection, at least while walking on the beach or seabed. One approach to avoiding such dangers is to wear a type of thin shoe or boot, sometime referred to as "booties." Such booties are typically made of neoprene, and have a bottom sole made of a harder rubber-like substance. In river rafting situations, it is common for the rafters to wear rafting sandals, which have a rubber-like sole and are attached to feet with nylon webbing and/or leather.

In a surfing environment, the surfer needs to walk down the beach to the water and then wade into the surf some distance before the water is deep enough to get on the board and start paddling. Once the water reaches a certain depth, the surfer gets on the board, typically on his belly, and starts paddling to get out to the area where the waves are breaking (sometimes referred to as a "line-up"). When a good wave approaches, the surfer must paddle the board vigorously for a short period back in the direction of the beach to give some speed to the board. At a critical point, as the board is lifted by the wave, the surfer stands up on the board to "catch" the wave.

Once standing, the surfer must maintain proper balance on the board, both forward and aft and side to side. It is helpful for the surfer to have bare feet during the surfing to have an intimate feel of the board and to be able to make fine adjustments to pressure by the feet and toes to various portions of the board. Booties or other footgear decrease the surfers intimate contact with the board and his sensitivity and control of the board. Rafting sandals would be considerably worse.

It would be desirable for a surfer to have some kind of footgear to protect his feet while walking down the beach to the water and while wading in the water up to the point of paddling. On the other hand, it would be desirable for the surfer to have bare feet while surfing to have maximum sensitivity to the board and be able to finely adjust pressure to various parts of the board with the feet and toes.

U.S. Pat. No. 8,839,529 (Levy) discloses sandals with reconfigurable straps to allow the sandals to be attached to the calves, thighs or arms, so that the sandals can be carried in a hands-free manner. These sandals are generally in the form of rafting sandals. While these sandals may be removed from the feet (so that they are bare) and carried on the body without having to hold them in the hands, they are not designed for surfing and would not work well in a surfing environment. For one thing, the straps would be difficult to reconfigure while paddling or sitting on a board. Secondly, because of their bulk and position, they may cause water resistance and hinder the surfer as he paddles vigorously to catch the wave. They may also interfere with the surfer's motion in the acrobatic balancing act of surfing. Finally, surfing is often viewed as an aesthetic and artistic sport, and the appearance of bulky sandals attached to various parts of the body would detract from this aesthetic aspect.

There remains a need for a type of footwear that would enable a surfer to walk on the beach and wade into the waves with the soles of his feet protected, and yet allow the surfer to have bare feet while surfing. Such footwear would preferably be easily converted from a walking orientation to a surfing orientation, and would provide little resistance to the vigorous paddling needed to catch the wave. Finally, they would preferably provide minimal detraction from desirable fluid motion or aesthetic artistry of surfing.

SUMMARY OF THE INVENTION

In a preferred embodiment, the invention provides a sandal for watersports that has a flexible sole having a walking configuration with said sole underlying a user's foot and a stowed configuration with said sole connected to the back of a user's leg. A forefoot strap connects over the user's forefoot in the walking configuration. An upper strap is attached to a heel portion of the sole and connects to the lower leg of a user. The flexible sole is sufficiently flexible to be bent and attached by means of said forefoot straps to the back of the leg of said user in said stowed configuration.

The sole may be configured to be bent inside out in said stowed configuration. The forefoot strap may be attached by means of a detachable connector to a user's forefoot in the walking configuration and to a user's leg in the stowed configuration. The detachable connector may be a hook-and-loop connector. The sole may be formed of neoprene.

DETAILED DESCRIPTION OF THE ILLUSTRATED EMBODIMENT

Figure 1:
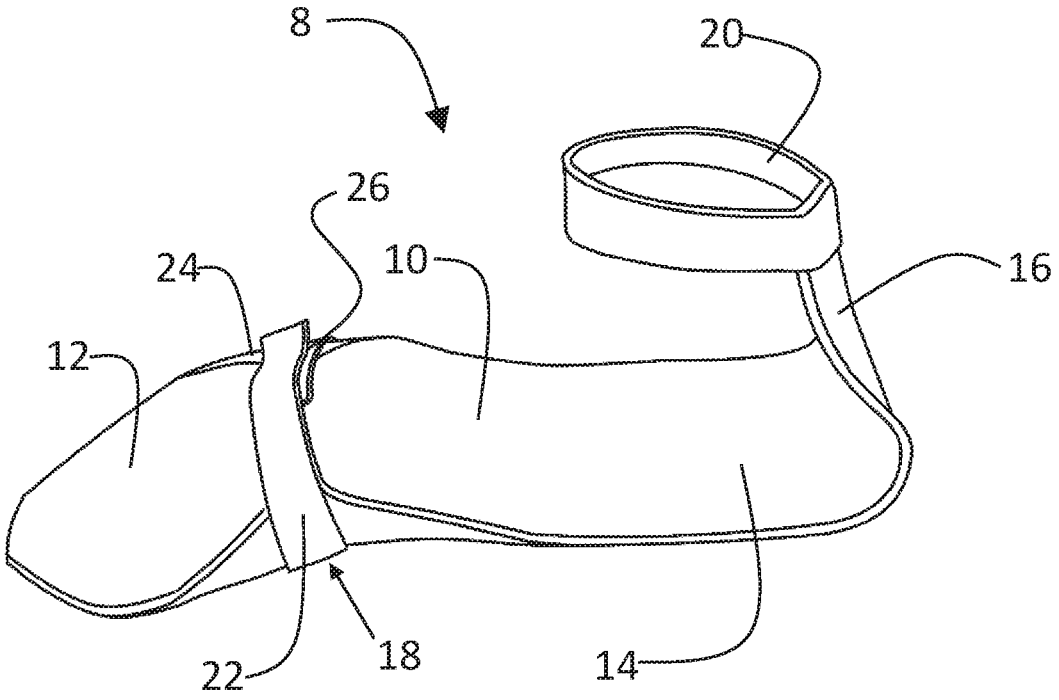
FIG. 1 is a perspective view of a water sports sandal of the invention shown in a walking configuration.

FIG. 1 is a perspective view of a sports sandal 8 of the invention. This sport sandal consists of a sole 10 having a forefoot portion 12, heel portion 14, and ankle portion 16. Sole 10 is formed of a thin flexible material, preferably neoprene, such as that used in wet suits or wet-suit booties. Other flexible, rubber-like or elastic materials may also be used.

A lower-leg strap 20 is attached to ankle portion 16, as shown. A forefoot strap 18 is attached to forefoot section 12, as shown. Forefoot strap 18 and lower-leg strap 20 are also formed of thin flexible material such as neoprene. They may also be made of other materials, such as various rubber-like or elastic materials or webbing made of nylon or polyurethane.

Forefoot strap 18 is comprised of strap 22 and strap 24, which are attached to forefoot portion 12 as shown. Straps 22 and 24 are preferably sewn to forefoot portion 12, and lower-leg portion 20 is preferably sewn to heel portion 14. Forefoot portion 18 and lower-leg portion 20 may also be attached to sole 10, by other means, such as adhesive, or a combination of adhesive and sewing.

Strap 22 attaches to strap 24 by means of a removable connector 26, such as hook-and-loop fasteners (known commercially as Velcro®). The "hook" portion are attached to one strap (e.g., strap 22) and the "loop" portion is attached to the other strap (e.g., strap 24). The hook and loop portions are detachably connected to each other by engagement of the hook and loop portions in a manner well known for garments, shoes, sporting goods and the like.

Figure 2:
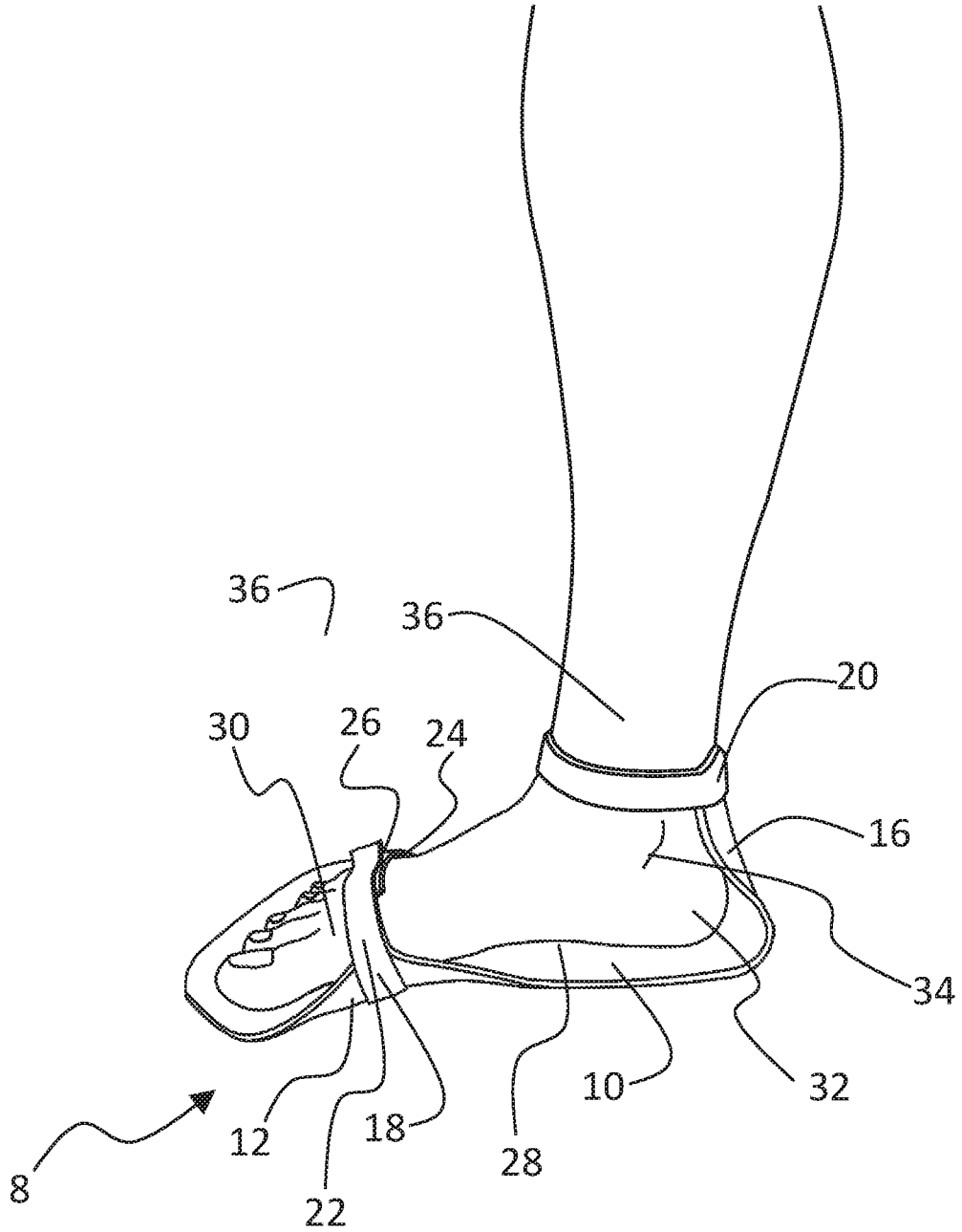
FIG. 2 is a perspective view of a water sports sandal of the invention worn by a user in a walking configuration.

FIG. 2 shows the sport sandal 8 being worn by a user with the sandal 8 in a walking configuration. As shown, in this configuration, sole 10 of sandal 8 underlies the bottom 28 a user's foot. Straps 22 and 24 are connected by means of connector 26 over the forefoot 30 of a user as shown to connect forefoot portion 12 of sole 10 to the user's foot. Lower-leg strap 20 encircles the lower leg 36 of the user to connect heel portion 16 of sole 10 to the lower leg of the user. Sole portion 10 wraps around the heel 32 of a user such that ankle portion 16 of sole 10 is positioned behind the user's heel.

In this configuration, the sole 10 protects the bottom 28 of a user's foot. For example, if the user were to walk or run over a beach that had sharp rocks, shells or other sharp objects, sole 10 would insulate the user's underfoot from such objects. If the user were to enter the water, the sole 10 would continue to protect the user's underfoot from objects like coral or sharp rocks. Since the sandal 8 is preferably made of neoprene or other similar rubber-like materials, it will not be damaged by contact with water.

Figure 3:
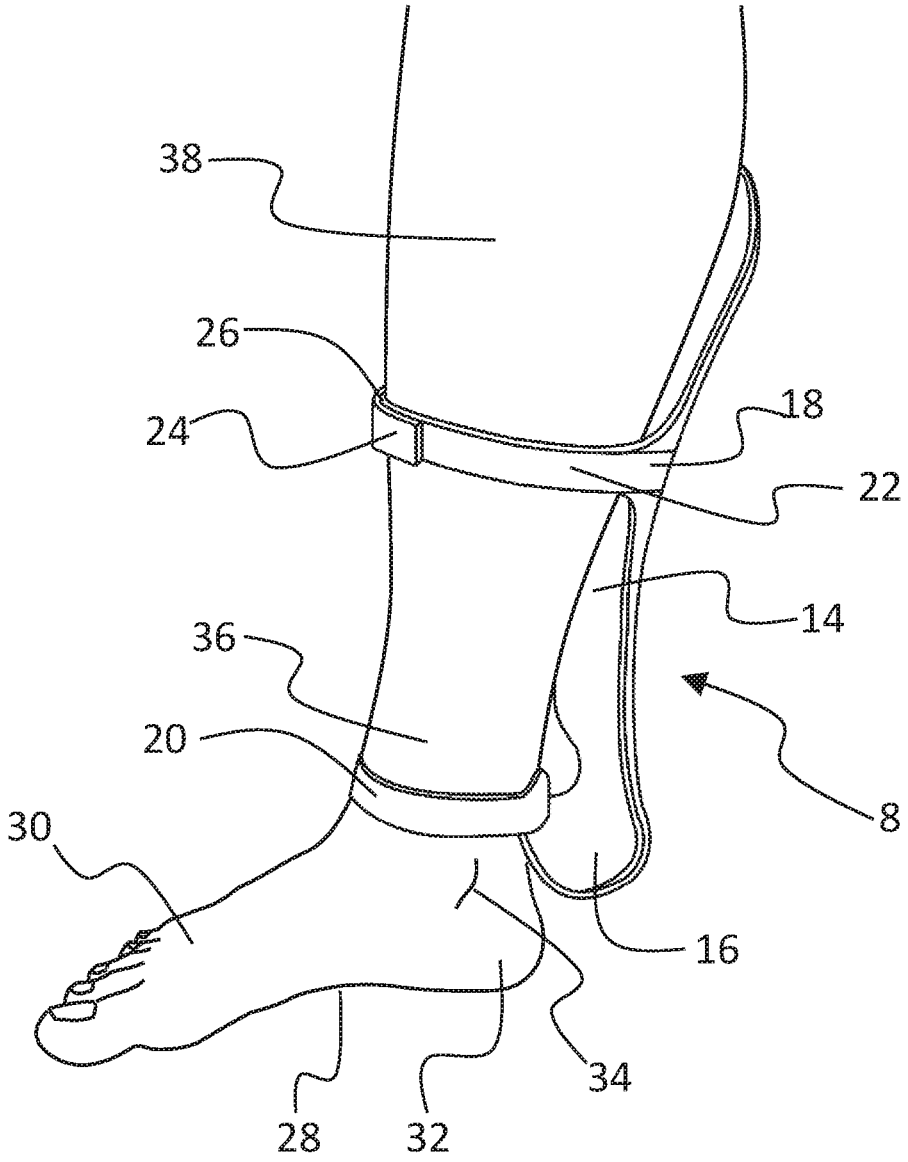
FIG. 3 is a perspective view of a water sports sandal of the invention worn by a user in a sports configuration.

FIG. 3 shows sandal 8 in a stowed configuration. In this configuration, sole 10 is folded back around the back of the user's lower leg, as shown. Forefoot strap 18 is now connected to the user's leg by means of straps 22 and 24 being wrapped around backwards, and connected to each other by means of connector 26. Heel portion 16 of sole 10 acts as a loose hinge to allow sole 10 to be so configured. Strap 20 remains connected in position around the lower leg 36 of the user.

Use of sandals is as follows: A surfer starts on the beach with the sandals on his feet in the walking configuration, as shown in FIG. 2. The surfer has his surfboard in his hands or under his arm and begins to walk down the beach. If the beach has sharp rocks or shells or if the sand is very hot, the surfer's foot is shielded from such problems by the sole 10 protecting his underfoot.

The surfer then enters the water and begins to wade out into the surf. Once again, if there are sharp objects under the water, such as coral or rocks, the soles 10 protect his feet. At some point the water gets deep enough to warrant paddling. At this point, the surfer gets on his board, with his belly down on the board, and begins to paddle out to the area where the waves are breaking (the "line-up"). The surfer may leave the sandals 8 on his feet in the walking configuration during this paddling period. Virtually all of the work of paddling is done with the arms, and the sandals provide no hindrance to this action.

At some point, the surfer reaches the area where the waves are breaking and where they can be "caught." At this point, the surfer typically sits on the board, and waits for the arrival of an acceptable wave. While sitting on the board, the surfer can reach down and disengage the attachment 26 on his sandals over the forefeet and reattach them around his lower legs to be in the stowed configuration shown in FIG. 3.

The surfer is now ready to surf. When an acceptable wave arrives, he lays down again on his board, belly down, and paddles vigorously toward shore in the direction the wave is traveling. The surfer must obtain sufficient speed to catch the wave. With the sandals 8 in the surfing configuration shown in FIG. 3, they do not provide excessive resistance to the vigorous paddling motion and speed of the surfer. The sandals 8 are on the back of the legs of the user, and essentially out of the water as the surfer lays on his belly and paddles.

As the wave lifts the surfboard, at a critical point, the surfer pushes his body to a standing position and begins to surf. At this point, the bare undersides of his feet are in contact with the board. As such, he can feel the movement of the board with great sensitivity. He can feel variations in the wave and can manipulate the board by fine variations in pressure applied to different parts of the board with his feet and toes. In this way, he can adapt to the changing nature of the wave and perform various tricks and moves known to surfers.

The advantages of the disclosed invention are thus attained in an economical, practical, and facile manner. While preferred embodiments and example configurations have been shown and described, it is to be understood that various further modifications and additional configurations will be apparent to those skilled in the art. It is intended that the specific embodiments and configurations herein disclosed are illustrative of the preferred and best modes for practicing the invention, and should not be interpreted as limitations on the scope of the invention as defined by the appended claims.

What is claimed is:

1. A sandal for water sports, comprising:

a flexible sole having a walking configuration with said sole adapted to underlie a user's foot and a stowed configuration in which the sole is configured to be connected to a lower portion of the user's leg and to expose a bottom of the user's foot;

a forefoot strap attached to said sole and connected over a forefoot of the user in said walking configuration, and an upper strap attached to said sole and configured to attach around the lower leg of the user with said flexible sole in said walking configuration, wherein said flexible sole is sufficiently flexible to be bent and attached by means of said forefoot strap to the lower portion of the leg of the user in said stowed configuration; and wherein said upper strap is configured to remain attached to the lower leg of the user as said sole is moved from said walking configuration to said stowed configuration.

2. A sandal according to claim 1, wherein said sole is configured to be bent inside out in said stowed configuration.

3. A sandal according to claim 2, wherein said sole is configured to be attached to a back of the user's leg in said stowed configuration.

4. A sandal according to claim 3, wherein said forefoot strap is configured to be attached by means of a detachable connector to the user's forefoot in said walking configuration and to the user's leg in stowed configuration.

5. A sandal according to claim 4, wherein said detachable connector is a hook-and-loop connector.

6. A sandal according to claim 5, wherein said sole is formed of neoprene.

7. A sandal for water sports, comprising:

a flexible sole configured to underlie a user's foot in a walking configuration and having a forefoot portion and a heel portion, said heel portion configured to wrap around a back of the user's heel;

a forefoot strap attached to said flexible sole at said forefoot position and adapted to connect a forefoot of the user to said sole in the walking configuration, and an upper strap attached to said heel portion and configured to connect said heel portion to the lower leg of the user with said sole in said walking configuration, said flexible sole being sufficiently flexible to bend around under the user's heel and against a back of the user's leg in a stowed configuration in which the sole is configured to expose a bottom of the user's fool, said forefoot strap being configured to connect said forefoot portion to a lower portion of-the user's leg with the sole in a said stowed configuration; and said upper strap being configured to remain attached to the lower leg of the user as said sole is changed from said walking configuration to said stowed configuration.

8. A sandal according to claim 7, wherein said sole is configured to be bent inside out in said stowed configuration.

9. A sandal according to claim 8, wherein said sole is configured to be attached to the back of the user's leg in said stowed configuration.

10. A sandal according to claim 9, wherein said forefoot strap has a detachable connector and is configured to be attached by means of the detachable connector to the user's forefoot in said walking configuration and to the user's leg in-the stowed configuration.

11. A sandal according to claim 10, wherein said detachable connector is a hook-and-loop connector.

12. A sandal according to claim 11, wherein said sole is formed of neoprene.

13. A sandal for water sports, comprising:

a flexible sole having a forefoot portion configured to underlie a user's forefoot in walking configuration and a heel portion configured to underlie and wrap around a back of the user's heel;

a detachable forefoot strap attached to said forefoot portion and configured to attach said forefoot portion to the user's forefoot in a said walking configuration; and an ankle strap attached to said heel portion and configured to attach to the lower leg of the user with said sole in said walking configuration;

wherein said sole is sufficiently flexible and is configured to be bent back around a bottom of the user's foot and inside out on the back of the user's leg in a stowed configuration so as to expose a bare underside of the user's foot, said detachable forefoot strap being configured to attach said sole to a back of the user's leg when said sole is in said stowed configuration so as to expose the bare underside of the user's foot said ankle strap being configured to remain attached to the lower leg of a user as said sole, is changed from said walking configuration to said stowed configuration.

14. A sandal according to claim 13, wherein said detachable connector is a hook-and-loop connector.

15. A sandal according to claim 14, wherein said sole is formed of neoprene.

* * * * *